United States Patent [19]

Tsai

[11] 4,399,674

[45] Aug. 23, 1983

[54] SELF-SHUT TYPE LOCK DEVICE

[76] Inventor: Kuo L. Tsai, 5, Lane 59, Chao Chou St., Taipei, Taiwan

[21] Appl. No.: 180,574

[22] Filed: Aug. 25, 1980

[51] Int. Cl.[3] ..... E05B 15/14; E05B 27/02

[52] U.S. Cl. ..... 70/364 A; 70/419; 70/421

[58] Field of Search ..... 70/416, 419, 421, 364 A, 70/362

[56] References Cited

U.S. PATENT DOCUMENTS

| | | | |
|---|---|---|---|
| 2,022,070 | 11/1935 | Williams | 70/421 |
| 2,032,974 | 3/1936 | Bradshaw | 70/421 |
| 2,049,548 | 8/1936 | Swanson | 70/421 |
| 4,083,210 | 4/1978 | Bergin | 70/362 |

*Primary Examiner*—Robert L. Wolfe

*Attorney, Agent, or Firm*—LeBlanc, Nolan, Shur & Nies

[57] ABSTRACT

A self-shut type lock device comprising a self-shut protector provided in the keyhole capable of hiding the lower tumbler segments from being picked through the keyhole.

7 Claims, 4 Drawing Figures

SELF-SHUT TYPE LOCK DEVICE

BACKGROUND OF THE INVENTION

The present invention relates to a self-shut type lock device, and more particularly to an improved lock device comprising a movable self-shut protector overslipped in the keyhole, capable of hiding the lower tumbler segments and preventing the same from being picked through the keyhole.

There are various kinds of conventional lock devices, but their construction are almost the same in principle. Generally the common drawback is that the keyholes are all open-type and that, if peeped through the keyhole, the profile configuration of the pin tumblers will be visible from outside so that the burglar can easily imitate or utilize his self-made master keys and other tools (such as a probe or steel wire) and detect the profile configuration of the lock's opening directly in a short time and then proceed to open it stealingly, making it not anti-burglar at all.

SUMMARY OF THE INVENTION

The primary objective of the present invention is to eliminate the above drawbacks and to provide an improved lock device with structural sophistication and absolute anti-burglar function in achieving the aim of full prevention of stealingly opening by somebody else.

BRIEF DESCRIPTION OF THE DRAWINGS

The above and further objects, features and advantages of the invention will be more apparent from the following description in conjunction with the accompanying drawings, wherein.

DETAILED DESCRIPTION OF THE DRAWINGS

Figure 2:
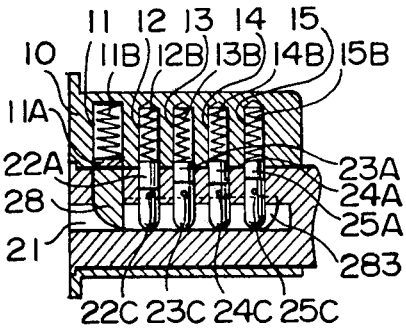
FIG. 2 is the longitudinal cross-sectional view of an embodiment of the present invention.
Figure 1:
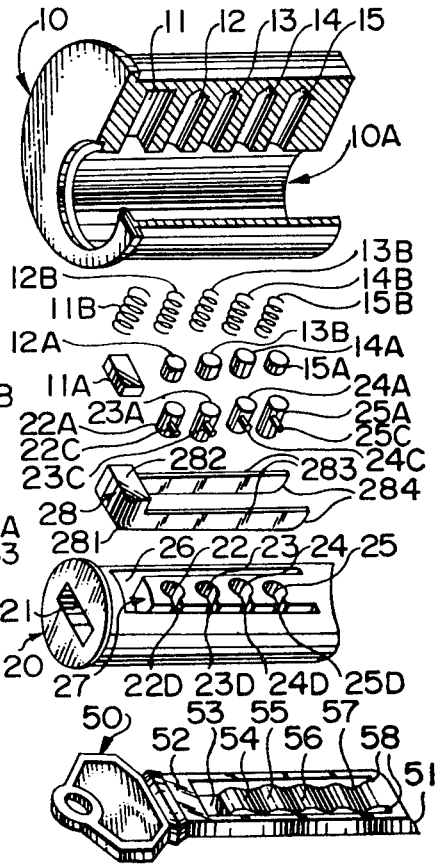
FIG. 1 is an exploded perspective view of whole parts in the embodiment of the present invention.

For the purpose of description, suppose four pin tumblers in the keyhole of the embodiment of the present invention are illustrated, and if desired, the number of them may be varied according to requirements.

As shown in the figures, the lock device of the present invention comprises the lock body 10 having a longitudinal central opening 10A, and a square tumbler-hole 11 and pin tumbler-holes 12, 13, 14, 15 perpendicular to the axis are cut in sequence on the internal circular face of said central opening 10A and communicating with one another. In said cylinder 20 is cut a keyhole 21 at its center, and on the outer circumference thereof is cut an "U-shaped" protector groove 26 communicated with said keyhole 21, thereby in whose center a tumbler-seat 27 is projecting out of the cylinder 20. Said tumbler-seat 27 is similarly cut a plurality of lower tumbler-holes 22, 23, 24, 25 with pin grooves 22D, 23D, 24D, 25D on its side wall, respectively, which are also communicated with the keyhole 21. The protector 28 with its stop-arms 283—283 having an "U-shaped" top configuration are previously overslipped into said "U-shaped" groove 26 of the cylinder 20, and the lower tumblers 22A, 23A, 24A, 25A fitted with their respective locking pins 22C, 23C, 24C, 25C are overslipped in the lower tumbler-holes 22, 23, 24, 25 of the cylinder 20 so that said locking pins 22C, 23C, 24C, 25C are movable within pin-grooves 22D, 23D, 24D, 25D, respectively. Further upper tumbler-holes 11, 12, 13, 14, 15 are formed by extending its depth into said lock body 10 and are in sequence overslipped with springs 11B, 12B, 13B, 14B, 15B and upper tumblers 11A, 12A, 13A, 14A, 15A, respectively. In this manner, said cylinder 20 is rotatably mounted in said central opening 10A of the lock body 10 so as to have each respective upper tumbler-holes 12, 13, 14, 15 just in alignment with their respective lower tumbler-holes 22, 23, 24, 25. In general, the protector 28 is exactly to make its top 282 flush with the outer surface of the cylinder 20, while the height of lower tumblers 22A, 23A, 24A, 25A are different with one another, and finally the external surface of the lock body 10 is secured by a rigid housing (not shown), thus making the members of whole lock-device integrated closely as one piece.

The section of the key 50 according to the present invention is made matching with that of the keyhole, one side of whose front end 51 is arched and on whose longer wide face 52 is cut an "U-shaped" groove 53 capable of being overslipped into said protector 28, at the center of the groove 53 a series of wavy grooves 54, 55, 56, 57 with different depth being cut from the key body, and the depth of said grooves depending upon the height of corresponding lower tumblers so as to match with each one for achieving opening of the lock device.

Figure 3:
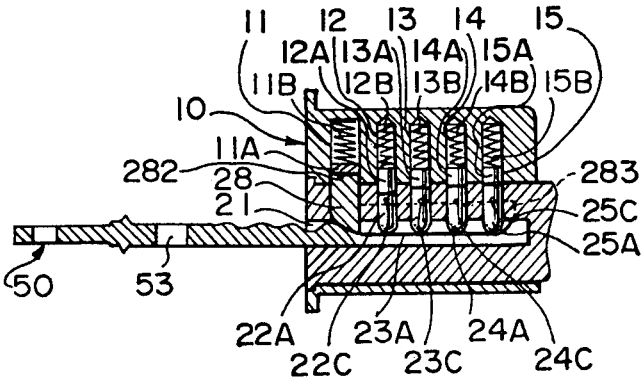
FIG. 3 is a longitudinal cross-sectional view of the embodiment just after insertion of a key into the keyhole to show the lift of the protector and the conditions of tumbler pins being stopped by the stop-arms of said protector.

When the key 50 is immediately inserted into the keyhole 21 and contacted with the arched portion 281 of the protector 28, pushing it upward as shown in FIG. 3, the top 282 of said protector 28 extends into the square tumbler-hole 11, and at the same time the stop-arm 283 of said protector 28 stops all the locking pins 22C, 23C, 24C, 25C, making lower ends of said lower tumblers 22A, 23A, 24A, 25A flush at the same height and contracted into their respective lower tumbler-holes along with said protector 28. Hence, if a burglar wishes trying to open the lock device of the present invention with a master key or other tools he cannot peep out the opening position of the lower tumblers 22A, 23A, 24A, 25A, and this is an important and a distinguishing characteristic of the present invention.

Figure 4:
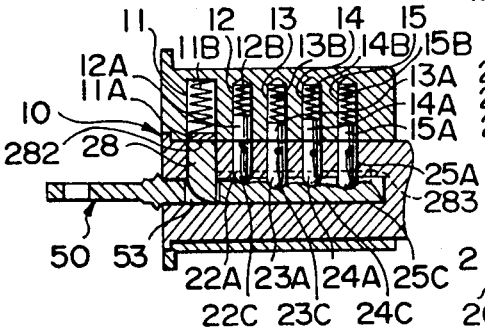
FIG. 4 is a longitudinal cross-sectional view of the embodiment after the key is completely inserted into the keyhole to show the lock device in the condition for being opened.

When the key 50 is completely inserted into the keyhole 21 the protector 28 passes through the U-shaped grooves 26 and 53 by means of the action of spring 11B and recover itself in original place, making its top 282 re-flush with the outer surface of cylinder 20, and after the lower-tumblers 22A, 23A, 24A, 25A run against simultaneously the wavy grooves 54, 55, 56, 57, the top of lower tumblers 22A, 23A, 24A, 25A are raised by exactly the amount correct to bring their tops flush with the outer surface of cylinder 20, as shown in FIG. 4, indicating that said cylinder 20 is freely rotatable and capable of releasing the door-bolt (not shown). Furthermore, whenever a small force is applied to the end concave rim 58—58 of the key 50, the arched portion 284—284 at the end of stop-arms 283—283 of the protector 28 and itself are readily withdrawn out.

It will be understood that if the locking pins on said lower tumblers are ommitted, said protector may also provide a self-shut means for preventing the cylinder from being rotated, because any raising or picking from the lower protion of said protector will push the height of the top of said protector over the outer circumference of said cylinder and therefore achieving the self-shut purpose of the present invention.

It is to pointed out that as the pin grooves only formed on the side wall of said lower tumbler-holes in the cylinder rather than extending through the upper tumbler-holes, the maximum movable range of said locking pins and the long stop-arms of said protector are thereby limited within said cylinder. This is one of important features of the present invention for providing an absolute anti-burglar function.

I claim:

1. A self-shut type lock device comprising: a key, a lock body having a longitudinal central opening within which is rotatably mounted a cylinder, said cylinder providing a keyhole at its center and a plurality of lower tumbler-holes with respective lower tumbler segments extending from its outer circumference to said keyhole, on the inner circumference of said central opening of said lock body, with respect to the location of each said lower tumbler-holes, a plurality of upper tumbler-holes being cut extending into said lock body, in which a plurality of springs and upper tumbler segments are overslipped therein, a U-shaped groove being cut on the outer circumference of said cylinder at the location in front of said lower tumbler-holes, said U-shaped groove communicating with said keyhole, inside which a protecting means is overslipped therein for self-hiding the lower tumbler segments and preventing the same from being picked through said keyhole, said protecting means including a U-shaped configuration having two long stop arms for raising all lower tumbler segments to the correct height to prevent said cylinder from being rotated.

2. A self-shut type lock device as claimed in claim 1, wherein said protecting means provides a self-shut means for preventing the cylinder from being rotated when the lower portion of said protecting means is once picked or raised.

3. A self-shut type lock device as claimed in claims 1 or 2 wherein the lower tumbler-holes in said cylinder further include a pin groove formed on its respective side wall communicating said lower tumbler-holes and said U-shaped groove therewith.

4. A self-shut type lock device as claimed in claims 1 or 2 wherein said lower tumbler segments further include a locking pin formed on their respective outer circumference and being movable within said pin grooves, respectively.

5. A self-shut type lock device as claimed in claims 1 or 2, wherein the movable range of two long stop-arms of said protecting means and locking pins are controlled within said cylinder.

6. A self-shut type lock device as claimed in claims 1 or 2, wherein said key further includes an U-shaped groove on its longer wide face for being overslipped into said protecting means, and at the center thereof a series of wavy grooves with different depths being cut from the key body.

7. A self-shut type lock device as claimed in claims 1 or 2, wherein said protecting means stops all locking pins and makes lower ends of said lower tumblers flush at the same height when the lower portion of said protecting means is raised.

* * * * *